United States Patent [19]

Kurachi et al.

[11] 4,148,937

[45] Apr. 10, 1979

[54] PROCESS FOR FIXING A TONER IMAGE

[75] Inventors: Hisashi Kurachi; Yoshihiro Sakamoto, both of Tokyo; Kaichi Tsuchiya, Fuchu; Hiroshi Yamakami, Tokyo; Tatsuo Miyamae; Seizi Tomari, both of Yokohama, all of Japan

[73] Assignee: Canon Kabushiki Kaisha, Tokyo, Japan

[21] Appl. No.: 758,779

[22] Filed: Jan. 12, 1977

Related U.S. Application Data

[63] Continuation of Ser. No. 547,353, Feb. 5, 1975, abandoned.

[30] Foreign Application Priority Data

Feb. 15, 1974 [JP] Japan ..... 49-18826

[51] Int. Cl.[2] ..... G03G 13/20; G03G 9/10

[52] U.S. Cl. ..... 427/194; 29/132; 252/61.2 P; 427/22; 427/195; 427/197

[58] Field of Search ..... 427/14, 22, 194, 197, 427/195; 252/62.1 P; 96/1 SD; 29/132

[56] References Cited

U.S. PATENT DOCUMENTS

| | | | |
|---|---|---|---|
| 3,090,755 | 5/1963 | Erchak et al. | 252/62.1 |
| 3,239,465 | 3/1966 | Rheinfrank | 252/62.1 |
| 3,293,059 | 12/1966 | Stowell | 427/22 |
| 3,493,412 | 2/1970 | Johnston | 427/22 |
| 3,510,338 | 5/1970 | Varron | 252/62.1 |
| 3,640,863 | 2/1972 | Okuno et al. | 252/62.1 |
| 3,904,786 | 9/1975 | Takiguchi | 427/22 |

*Primary Examiner*—Ronald H. Smith
*Assistant Examiner*—Stuart D. Frenkel
*Attorney, Agent, or Firm*—Fitzpatrick, Cella, Harper & Scinto

[57] ABSTRACT

A process for fixing a toner image formed on a support by means of a heat roller according to the present invention comprises fixing the toner image developed by using a toner containing as the binder resin a styrene-butadiene copolymer containing 70 to 95 mole % of styrene.

12 Claims, 1 Drawing Figure

PROCESS FOR FIXING A TONER IMAGE

This is a continuation, of application Ser. No. 547,353, filed Feb. 5, 1975, now abandoned.

BACKGROUND OF THE INVENTION

1. Field of the Invention

The present invention relates to an improvement in a process for fixing a toner image obtained by the electrophotographic technique, electrostatic printing and the like, and more particularly it is concerned with an improvement in the prevention of paper-winding and the offset phenomenon, which have caused problems at the time of fixing the toner image by means of a heat roller.

2. Description of the Prior Art

It has been heretofore known that an electrostatic latent image formed on a photoconductive layer or an insulating layer is developed by using charged fine particles, that is, a toner and the thus obtained toner image is fixed to produce a copy, and it has also been known that after development of the electrostatic latent image, the toner image is transferred to a transfer material and fixed to produce a copy.

As a process for fixing the toner image, various processes have been known, for example, a process of heating and melting the toner by means of a heater, etc. to cause the melted toner to adhere to a support and solidify it, a process of softening or dissolving the binder resin of the toner with an organic solvent to fix the toner on a support by the evaporation of the organic solvent, and the like. Further, another process also has been known, in which a toner image obtained on a support is caused to pass between heat rollers so that the toner is melted, solidified and fixed by the heat and pressure. Such a fixing process using a heat roller is disclosed in, for example, U.S. Pat. Nos. 3,108,863, 3,612,820, 3,649,992, 3,743,403 and 3,751,216. The abovementioned prior art fixing process using a heat roller has many advantages e.g., the toner image is directly brought into contact with the heated region of the heat roller so that the toner is melted at a very high efficiency and thereby the fixing efficiency and fixing rate are improved resulting in reduction of the electric power consumed, a small size apparatus and prevention of fire. However, the prior art fixing process is disadvantageous in that the image quality is deteriorated on account of the paper-winding and offset phenomenon. The expression "paper-winding" as used herein means that the paper adheres to and winds around the heat roller, and "offset phenomenon" means that a part of the toner melts and adheres to the heat roller.

For eliminating such disadvantages, heretofore, Teflon, silicone and the like have been applied to the surface of the heat roller to prevent the paper-winding and to avoid the offset phenomenon. This counterplan is considered effective to some extent, but it is not completely satisfactory.

It has been found from the various studies of the present inventors that when the following relationship is satisfied:

$$F_{TR} < F \sim F_{TP}$$

wherein $F_{TR}$ is the interfacial tension between the heat roller and the toner, F is the cohesion between toner particles and $F_{TP}$ is the interfacial tension between the toner and the paper, no paper adheres and winds around the heat roller, nor does the offset phenomenon occur so that the toner image can be effectively fixed.

The factors determining $F_{TR}$ are mainly the surface free energy of the heat roller and that of the toner. In order to effectively prevent a paper from adhering and winding around the heat roller and avoid the offset phenomenon, the surface free energy of the heat roller should be lowered as far as possible and that of the toner should be made higher. In this case, if the surface free energy of the toner is higher than that of the paper, the toner hardly fixes on the paper. The surface free energy of the toner should be appropriately selected. Further, a high molecular material which is a main constituent of the toner is generally a material of a low surface free energy. Among such high molecular materials, even the material of a higher surface free energy exhibits only a surface free energy lower than that of water. Consequently, the range of the surface free energy of the toner is also restricted in view of the material.

Teflon, silicone, etc., which have been applied to the surface of a heat roller as a releasing agent, have a critical surface tension of 17 to 18 dyne/cm, and polystyrene, polymethyl methacrylate, etc. of a relatively high surface free energy which are considered suitable as the binder resin of the toner for the process for fixing the toner image using a heat roller have a critical surface tension of 34 to 37 dyne/cm. From this fact, it has been expected at first that no paper would adhere and wind around the hot roller, nor would the offset phenomenon occur as mentioned above. In practice, however, the study of the present inventors has showed that the binder resin of the toner is melted within the range of the temperature at which the toner is sufficiently fixed on the paper and the surface free energy of the toner is extremely lowered so that the paper adheres to and winds around the heat roller. In other words, it has been found that the cohesion of the thus melted toner is extremely decreased as compared with the solid state thereof and that even when a material of a relatively large critical surface tension is used as the binder resin of the toner, the paper adheres to and winds around the heat roller and the offset phenomenon takes place.

As a result of the study of various binder resins for the purpose of preventing the cohesion of the toner from decreasing in the melted state, it has been found that a rubber-like material usually exhibits a cohesion lower than that of a resin, but within the range of the fixing temperature onto a paper, etc., its cohesion is larger than that of a resin. This finding further has showed that when a rubber-like material is used as the binder resin of a toner, the lowering of the cohesion of the toner in the melted state can be restrained, and the paper-winding and the offset phenomenon which are liable to take place at the time of fixing the toner image using the heat roller can be prevented.

Generally, the binder resin of a toner should be that capable of giving a toner having the following properties: (1) it should be excellent in its powdering property, (2) it should be completely fixed on a support for the toner image such as paper, film and the like at a temperature at which the support is not scorched, (3) it should be excellent in its triboelectric property, (4) it should exhibit good transferability in the transferring type process, and the like. However, the above-mentioned rubber-like material is not satisfactory in these properties required for the binder resin of a toner. In particular, the rubber-like material is extremely poor in powdering property since it exhibits a rubber-like elasticity at a normal temperature, and it is very difficult to fix the rubber-like material on a paper, film and the like.

A process for fixing a toner image according to the present invention has been developed on the basis of the view of the present inventors that when a heat roller is used to fix a toner image, the toner to be used should be a particular toner which is different from that having been used in the conventional fixing process.

SUMMARY OF THE INVENTION

The present inventors have made a study of a toner suitable for a process for fixing a toner image using a heat roller from the various points of view as mentioned above and found that the toner prepared by using a particular styrene-butadiene copolymer as the binder resin is satisfactory in the various properties as pointed out in the foregoing.

It is therefore an object of the present invention to provide a process for fixing a toner image by means of a heat roller which is free from the paper-winding and the offset phenomenon when the toner image is fixed by means of the heat roller.

It is another object of the present invention to provide a toner for use in electrophotography which is particularly suitable for a fixing process using a heat roller.

According to an aspect of the present invention, there is provided a process for fixing a toner image formed on a support by means of a heat roller which comprises fixing the toner image developed by using a toner containing as the binder resin a styrene-butadiene copolymer containing 70 to 95 mole % of styrene.

According to another aspect of the present invention, there is provided a toner for an electrostatic latent image which comprises as the binder resin a styrene-butadiene copolymer containing 70 to 95 mole % of styrene, the amount of the copolymer being larger than 15% by weight based on the binder resin.

BRIEF DESCRIPTION OF THE DRAWINGS

In the drawing, the FIGURE is an explanatory view of an example of a fixing machine including a heat roller used in the present invention.

DESCRIPTION OF THE PREFERRED EMBODIMENTS

Figure 1:
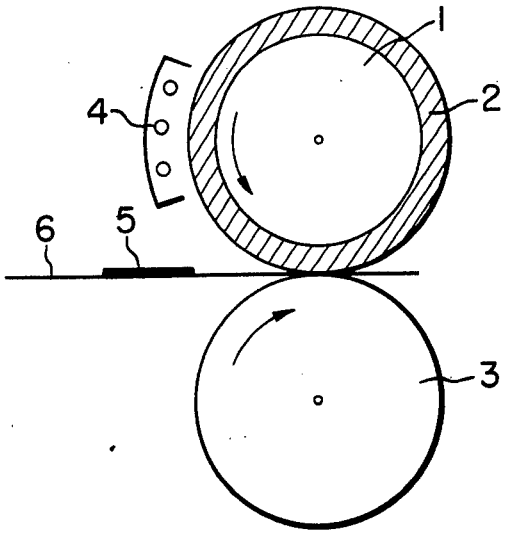

In accordance with the present invention, when a toner image having been developed by using the toner containing as the binder resin a styrene-butadiene copolymer containing 70 to 95 mole % of styrene is fixed by means of a heat roller, no paper adheres to and winds around the heat roller, nor does the offset phenomenon occur, and further the temperature at which the toner image is fixed on a paper and the like may be low. Consequently, the fixing process of the present invention can be applied to a high speed fixing.

As described above, a styrene-butadiene copolymer is used in the present invention as the binder resin of the toner and the differences between the fixing point and the offset point of the toner image is at least 60° C. When the content of the styrene in the styrene-butadiene copolymer is smaller than 70 mole %, the copolymer becomes poor in the powdering property when a toner powder is prepared, and therefore it may not be practical. On the other hand, when the content of the styrene is larger than 95 mole %, the offset point at which the offset phenomenon occurs and the like rapidly lower, and therefore, it becomes difficult to satisfactorily attain the purpose of the present invention.

The styrene-butadiene copolymer to be used in the present invention may be preferably that containing 70 to 95 mole % of styrene, and more preferably that containing 80 to 90 mole % of styrene.

As mentioned in the foregoing, the present invention is based upon the discovery of the properties of such particular styrene-butadiene copolymer. In the preparation of a toner, various resins which have been so far used as the binder resin of a toner for the conventional electrophotography may be used along with the above-mentioned copolymer for the purpose of improving the powdering property of the toner. Generally, to prepare the toner, a pigment is mixed with and dispersed in a solid dry resin binder, more than 15% of which is the above-described styrene-butadiene copolymer.

For example, a chlorinated paraffin, polyester resin, polystyrene, epoxy resin, polyterpene, polyvinyl chloride, a styrene-methyl methacrylate copolymer, a phenolic resin and the like may be preferably used.

In this case, the amount of the styrene-butadiene copolymer (styrene content: 70 to 95 mole %) is varied depending on the nature of the resin to be mixed together, but it should be larger than 15% by weight, and preferably larger than 30% by weight. If the amount is smaller than 15% by weight, the above-mentioned effect can not be satisfactorily attained.

As the binder resin of the toner to be used in the present invention, the styrene-butadiene copolymer (styrene content: 70 to 95 mole %) may be used singly or in combination with other resins as mentioned above. In addition, as the dye, pigment, charge controlling agent and the like to be contained in the toner, those having been so far used in preparing the toner for the conventional electrophotography may be optionally used.

The heat roller to be used in the present invention may be one that has been used in the conventional fixing process using a heat roller. However, at least the surface of the roller, specifically the surface which is brought into contact with the toner image is preferably of a critical surface tension of less than 25 dyne/cm, more preferably less than 20 dyne/cm.

As representative materials capable of giving such a surface, there may be mentioned a fluorine type material such as polyfluorovinylidene, polytrifluoroethylene, polytrifluorochloroethylene, polytetrafluoroethylene, polyhexafluoropropylene, an ethylene tetrafluoride-propylene hexafluoride copolymer, fluorinated rubber, a perfluoroalkyl ester polymer and the like, a silicone type material such as a siloxane polymer, for example, methyl hydrogen polysiloxane and dimethyl polysiloxane, silicone wax, silicone rubber, a silazane polymer and the like, chloroprene rubber, polyvinyl butyral, polypropylene and the like. These materials may be used singly or in combination and mixed with other materials.

The invention will be understood more readily with reference to the following examples, however, these examples are intended to illustrate the invention and are not to be construed as limiting the scope of the invention. Parts are by weight unless otherwise specified.

EXAMPLE 1

With a ball mill, 100 parts of a styrene-butadiene copolymer (styrene: butadiene = 85:15) which was prepared by emulsion polymerization, 6 parts of carbon black and 2 parts of Zapon Fast Black-B (a trade name of a metal complex dye supplied by Badische Anilin and Soda Fabrik) were premixed and then the mixture was melted and kneaded with a roll mill. After cooling the kneaded mixture, it was coarsely ground with a hammer mill and finely pulverized with a jet mill to prepare a toner. The particle size of the toner is preferably 5 to 25 microns. 15 parts of the toner and 85 parts of EF300-500 (a trade name of iron powder carrier supplied by Nippon Teppun K.K.) having a particle size ranging from 300 to 500 mesh, were mixed together to obtain a dry type developer.

The thus obtained developer was used to form an unfixed image by using a commercially available dry development - transferring type electro-copying machine (NP-1100, trade name for a product of Canon K.K.). The unfixed image was subjected to fixing using a heat roller for fixation as shown in FIG. 1 at a roll temperature of 150° C. so that it was perfectly fixed without occurrence of the paper-winding and offset phenomenon.

The temperature at which the toner was perfectly fixed (hereinafter called "fixing point") and the temperature at which the offset phenomenon took place (hereinafter called "offset point") were measured by using the fixing apparatus as shown in FIG. 1. It was found that the fixing point was 130° C. and no offset phenomenon took place even at 200° C.

In FIG. 1, numeral 1 denotes a heat roller made of a metal, to the surface of which silicone rubber as denoted by numeral 2 is applied. Numeral 3 denotes a counter metal roller. Numerals 4, 5 and 6 denote a heater for heating, a toner image and a support for the toner image, respectively. The measurement of the fixing point and offset point was carried out in such a manner that the surface temperature of the roller was maintained constant by controlling the heater and a black solid image was caused to pass between the rollers at a revolution speed of 200 mm/sec, and subsequently, the surface temperature of the roller was successively raised.

EXAMPLE 2

Toners were prepared in the same manner as that in Example 1 except that the under-listed copolymers were respectively substituted for the styrene-butadiene copolymer. Each of the thus prepared toners was subjected to the measurement of the fixing point and offset point. The results are shown in the following table. For the purpose of comparison, polystyrene alone was used to conduct the same procedure. The results are also shown below.

| Styrene-butadiene copolymer | | | |
|---|---|---|---|
| Styrene (mole %) | butadiene (mole %) | Fixing point (° C) | Offset point (° C) |
| 70 | 30 | 130 | 200 or more |
| 80 | 20 | 130 | 200 or more |
| 90 | 10 | 130 | 200 or more |
| 95 | 5 | 130 | 195 |
| Polystyrene | | 125 | 130 |

EXAMPLE 3

With a ball mill, 40 parts of a styrene-butadiene copolymer (styrene: butadiene = 85:15) prepared by emulsion polymerization, 30 parts of epoxy resin, 30 parts of a chlorinated paraffin, 6 parts of carbon black and 2 parts of a metal complex dye were premixed, and then the mixture was melted and kneaded with a roll mill. The kneaded mixture was coarsely ground with a hammer mill and then finely pulverized with a jet mill to prepare a toner. The preferred particle size of the toner is from 5 to 25 microns.

15 parts of the thus prepared toner and 85 parts of iron powder carrier (having particle size of 300 to 500 mesh) were mixed to obtain a dry type developer. With the thus obtained developer, an unfixed image was produced by using a commercially available dry type electro-copying machine (NP-1100: trade name for the product of Canon K.K.) and it was found that the image was very excellent.

The separating property of this toner was tested with respect to the fixing point and offset point in the aforementioned manner. The test indicated that the fixing point was 130° C. and no offset phenomenon took place up to 200° C. In addition, it was found that the toner was considerably improved in the powdering property when it was ground.

EXAMPLE 4

Toners were prepared in the same manner as that in Example 3 except that the styrene-butadiene copolymer was combined with each of the binder resins as enumerated below, and the fixing point and offset point of the toners were measured, the results of which are shown in the following table.

| Styrene-butadiene copolymer (part) | Mixed resin (part) | | Fixing point (° C) | Offset point (° C) |
|---|---|---|---|---|
| | Chlorinated paraffin | 40 | | |
| 20 | | | 130 | 190 |
| | Polyester resin | 40 | | |
| 30 | Polystyrene | 70 | 130 | 200 or more |
| 50 | Chlorinated paraffin | 50 | 130 | 200 or more |
| 60 | Epoxy resin | 40 | 130 | 200 or more |
| 70 | Polyterpene | 30 | 130 | 200 or more |
| 80 | Polyvinyl chloride | 20 | 130 | 200 or more |
| 90 | Styrene-methyl methacrylate copolymer | 10 | 130 | 200 or more |

In addition, the same experiment as in the foregoing was conducted by substituting polytrifluoroethylene, fluorinated rubber, polyhexafluoropropylene, dimethyl polysiloxane, chloroprene rubber and the like for the coating material of the surface of the heat roller so that the same results were obtained.

We claim:

1. In a process for fixing a toner image formed on a support comprising contacting the toner image with a heated roller and heating the toner image to a temperature not lower than the fixing point of the toner image but not higher than the offset point of the toner image at which point the toner image adheres to the surface of the heated roller, wherein the toner comprises a pigment dispersed in a solid resin binder and is obtained by mixing and dispersing said pigment in said solid dry resin binder, the improvement comprising said binder consisting essentially of more than 15 percent by weight based on the total weight of the binder, of a styrene-butadiene copolymer containing from 70 to 95 mole percent of styrene, wherein the difference between the fixing point and the offset point for said toner image is at least 60° C.

2. A process for fixing a toner image according to claim 1, in which said binder contains said styrene-butadiene copolymer in an amount of more than 30% by weight based on the weight of said binder.

3. A process for fixing a toner image according to claim 1, wherein said styrene-butadiene copolymer contains from 80 to 90 mole percent of styrene.

4. A process for fixing a toner image according to claim 2, wherein said styrene-butadiene copolymer contains from 80 to 90 mole percent of styrene.

5. A process for fixing a toner image according to claim 1, in which said binder additionally contains less than 85% by weight, based on the weight of said binder, of at least one resin selected from the group consisting of chlorinated paraffin, polyester resin, polystyrene, epoxy resin, polyterpene, polyvinyl chloride, a styrene-methyl methacrylate copolymer and phenolic resin.

6. A process for fixing a toner image according to claim 1, in which at least the surface of the said roller which contacts said toner image comprises a material which has a critical surface tension of less than 25 dyne/cm.

7. A process for fixing a toner image according to claim 1, in which at least the surface of said heat roller which contacts said toner image comprises a material which has a critical surface tension of less than 20 dyne/cm.

8. A process for fixing a toner image according to claim 1, in which the surface of said heat roller which contacts said toner image comprises a material selected from the group consisting of polyfluorovinylidene, polytrifluoroethylene, polytrifluorochloroethylene, polytetrafluoroethylene, polyhexafluoropropylene, an ethylene tetrafluoride-propylene hexafluoride copolymer, fluorinated rubber, a perfluoroalkyl ester copolymer, methyl hydrogen polysiloxane, dimethyl polysiloxane, silicone wax, silicone rubber, a silazane polymer, chloroprene rubber, polyvinyl butyral and polypropylene.

9. A process for fixing a toner image according to claim 1 wherein said binder consists of said styrene-butadiene copolymer.

10. A process for fixing a toner image according to claim 2, wherein said binder additionally consists essentially of less than 70% by weight, based on the weight of said binder, of at least one resin selected from the group consisting of chlorinated paraffin, polyester resin, polystyrene, epoxy resin, polyterpene, polyvinyl chloride, a styrene-methyl methacrylate copolymer and phenolic resin.

11. A process for fixing a toner image according to claim 10, wherein at least the surface of said heated roller which contacts said toner image comprises a material which has a critical surface tension of less than 25 dyne/cm.

12. A process for fixing a toner image according to claim 11, wherein said material is selected from the group consisting of polyfluorovinylidene, polytrifluoroethylene, polytrifluorochloroethylene, polytetrafluoroethylene, polyhexafluoropropylene, an ethylene tetrafluoride-propylene hexafluoride copolymer, fluorinated rubber, a perfluoroalkyl ester copolymer, methyl hydrogen polysiloxane, dimethyl polysiloxane, silicone wax, silicone rubber, a silazane polymer, chloroprene rubber, polyvinyl butyral and polypropylene.

* * * * *